US006386082B2

(12) United States Patent
Lee

(10) Patent No.: US 6,386,082 B2
(45) Date of Patent: May 14, 2002

(54) PAPER CUTTER

(75) Inventor: Cheng-Chen Lee, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 09/732,297

(22) Filed: Dec. 8, 2000

(30) Foreign Application Priority Data

Jul. 21, 2000 (TW) ..... 89212658 U

(51) Int. Cl.[7] ..... B26D 1/12
(52) U.S. Cl. ..... 83/605; 83/694; 83/698.11
(58) Field of Search ..... 83/605, 606, 698.11, 83/698.31, 699.31, 694, 670, 673

(56) References Cited

U.S. PATENT DOCUMENTS 678,441 A * 7/1901 Stevens ..... 83/607
884,219 A * 4/1908 Scates ..... 83/607 X
2,270,473 A * 1/1942 Porcelli ..... 83/607 X
2,518,076 A * 8/1950 Scherig ..... 83/607 X
2,573,767 A * 11/1951 Jensen et al. ..... 83/605 X
4,957,235 A * 9/1990 Beno et al. ..... 83/468 X
5,320,011 A * 6/1994 Lee ..... 83/607 X
D443,294 S * 6/2001 Munoz ..... D18/34

* cited by examiner

*Primary Examiner*—M. Rachuba
*Assistant Examiner*—Jason Prone
(74) *Attorney, Agent, or Firm*—Winston Hu

(57) ABSTRACT

A paper cutter includes a main board and a cutting member. The main board has a side blade attached to an engaging side for positioning of a document, and a slant surface formed at a front portion of the engaging side. The slant surface extends outwards from a predetermined position of the engaging side to form a first acute angle, and the slant surface further extends outwards from its upper edge to form an obtuse angle. The cutting member includes an edge blade fixed on one side for engaging with the side blade of the main board for cutting the document. The edge blade extends outward from its top side so as to form a second acute angle with the flat surface of the side blade.

10 Claims, 5 Drawing Sheets

PAPER CUTTER

BACKGROUND OF THE INVENTION

1. Field of the Invention

The present invention provides a paper cutter, and more particularly, to a paper cutter that can improve both manufacturing efficiency and document-cutting.

2. Description of the Prior Art

The edge blade and main board of a paper cutter of the prior art are positioned after manufacturing of the paper cutter. However, the positioning procedure is laborious and can lead to misalignment between the edge blade and main board to result in inferior cutting.

Please refer to FIG. 1. FIG. 1 is a schematic diagram of a prior art paper cutter 10. The paper cutter 10 includes a cutting member 11, a main board 12 for document placement, a side blade 13 fixed on the engaging side of the main board 12, and a positioning element 16 for adjusting the positions of the cutting member 11 and the main board 12. The cutting member 11 includes a handle 17 and an edge blade 14. The handle 17 is used to lift the edge blade 14 while the edge blade 14 engages with the side blade 13 of the main board 12 to cut the document.

Generally, it takes approximately six minutes to manufacture a paper cutter 10, and approximately 3 to 4 minutes to adjust the positioning element 16. However, after a period of use, the positioning element 16 of the paper cutter 10 may no longer be fixed at the manufactured position to cause misalignment between the cutting member 11 and the main board 12.

SUMMARY OF THE INVENTION

It is an objective of the present invention to provide a paper cutter without positioning elements to improve manufacturing efficiency, decrease labors cost, and prevent poor document-cutting.

In accordance with the claimed invention, a paper cutter includes a main board for document placement. The main board comprises a side blade attached to an engaging side of the main board, a slant surface formed on the front portion of the engaging side,. The side blade has a flat surface perpendicular to the upper surface of the main board while the slant surface extends outwards from a predetermined position of the engaging side to form a first acute angle with the flat surface of the side blade. The slant surface further extends outwards from its upper edge to form an obtuse angle with the upper surface of the main board.

These and other objectives of the present invention will no doubt become obvious to those of ordinary skill in the art after reading the following detailed description of the preferred embodiment which is illustrated the various figures and drawings.

DETAILED DESCRIPTION OF THE PREFERRED EMBODIMENT

Figure 1:
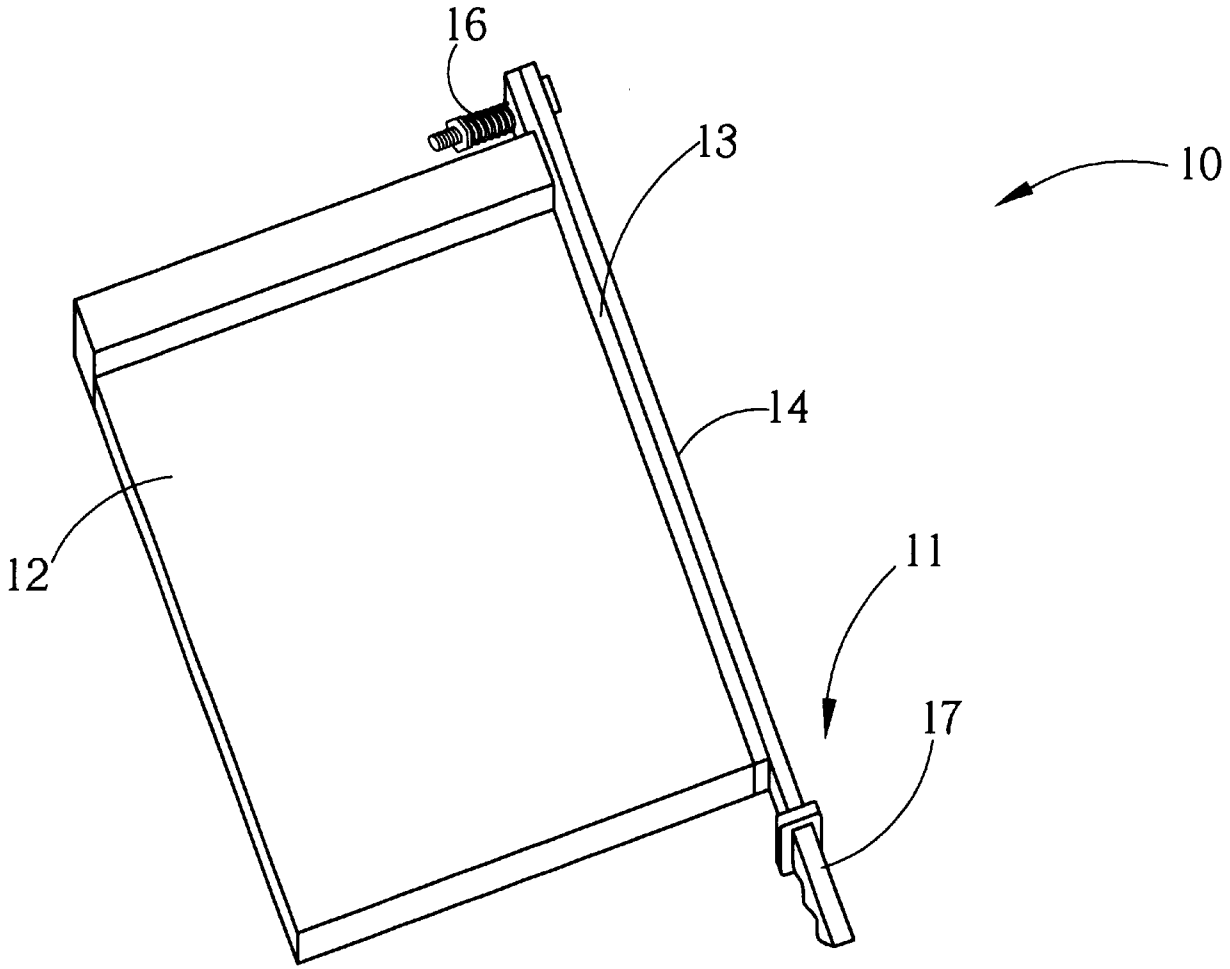
Fig. 1 Prior art
FIG. 1 is a schematic diagram of a prior art paper cutter.
Figure 2:
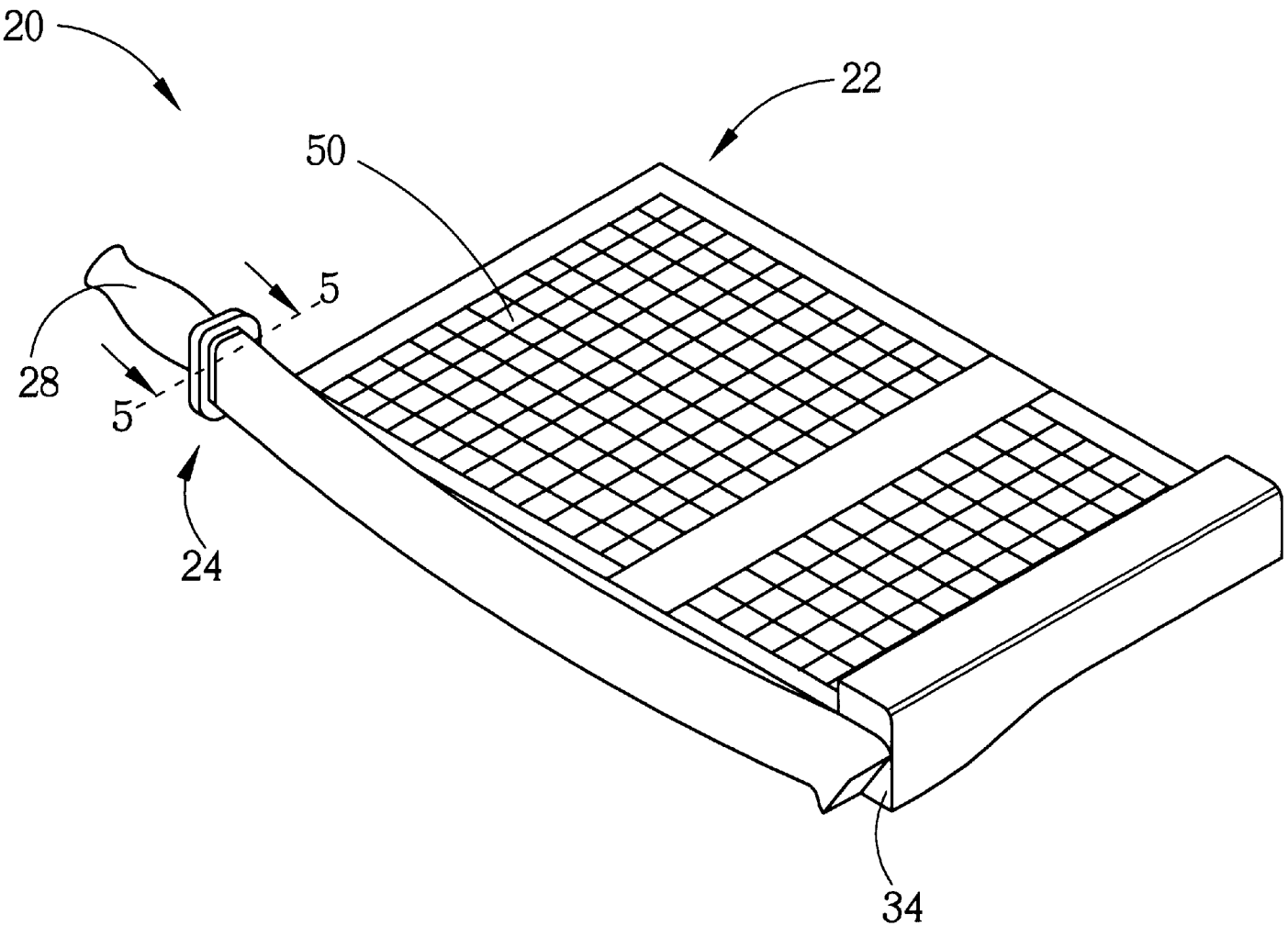
FIG. 2 is a schematic diagram of a paper cutter of the present invention.
Figure 3:
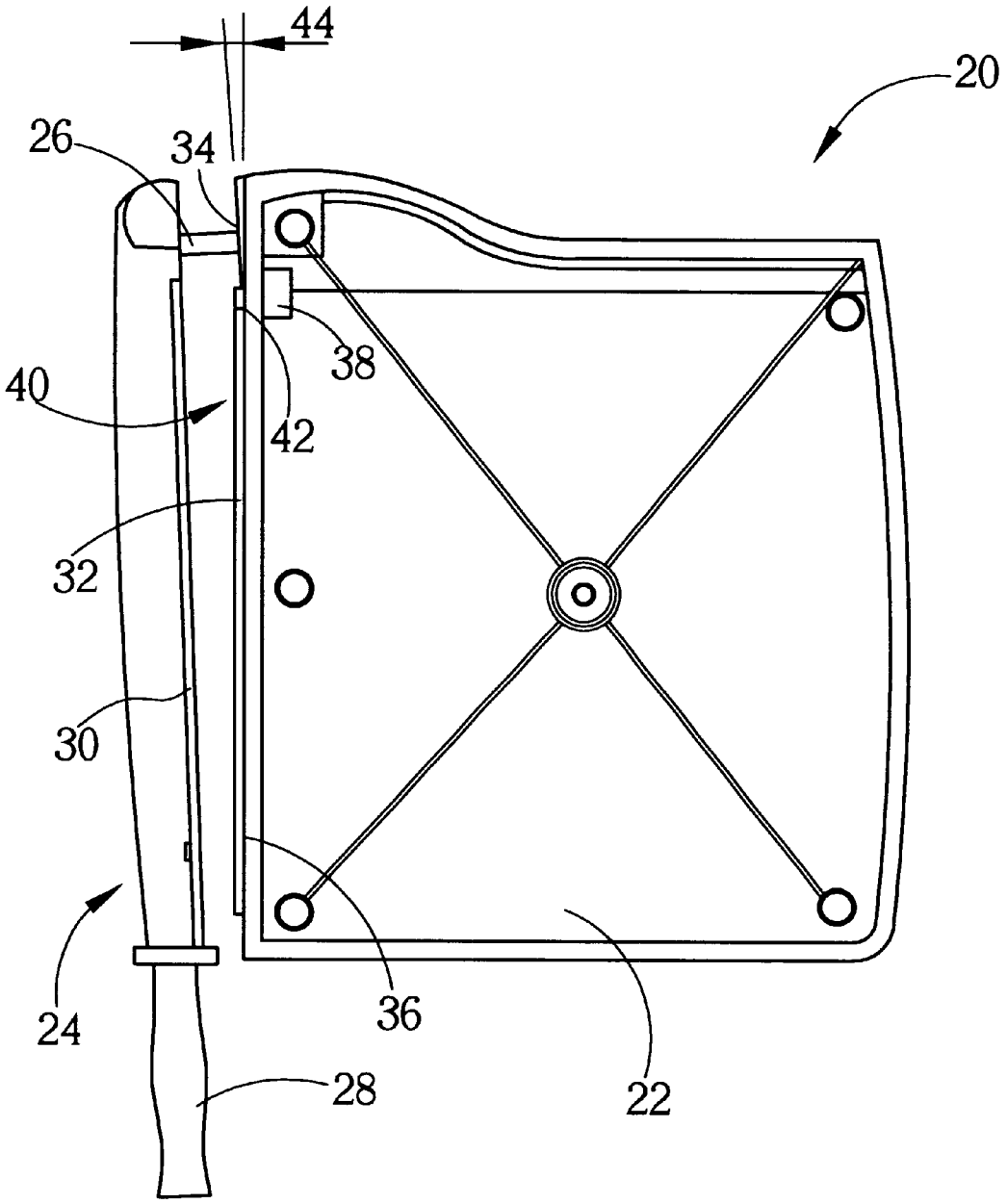
FIG. 3 is a bottom view of the paper cutter of FIG. 2.
Figure 4:
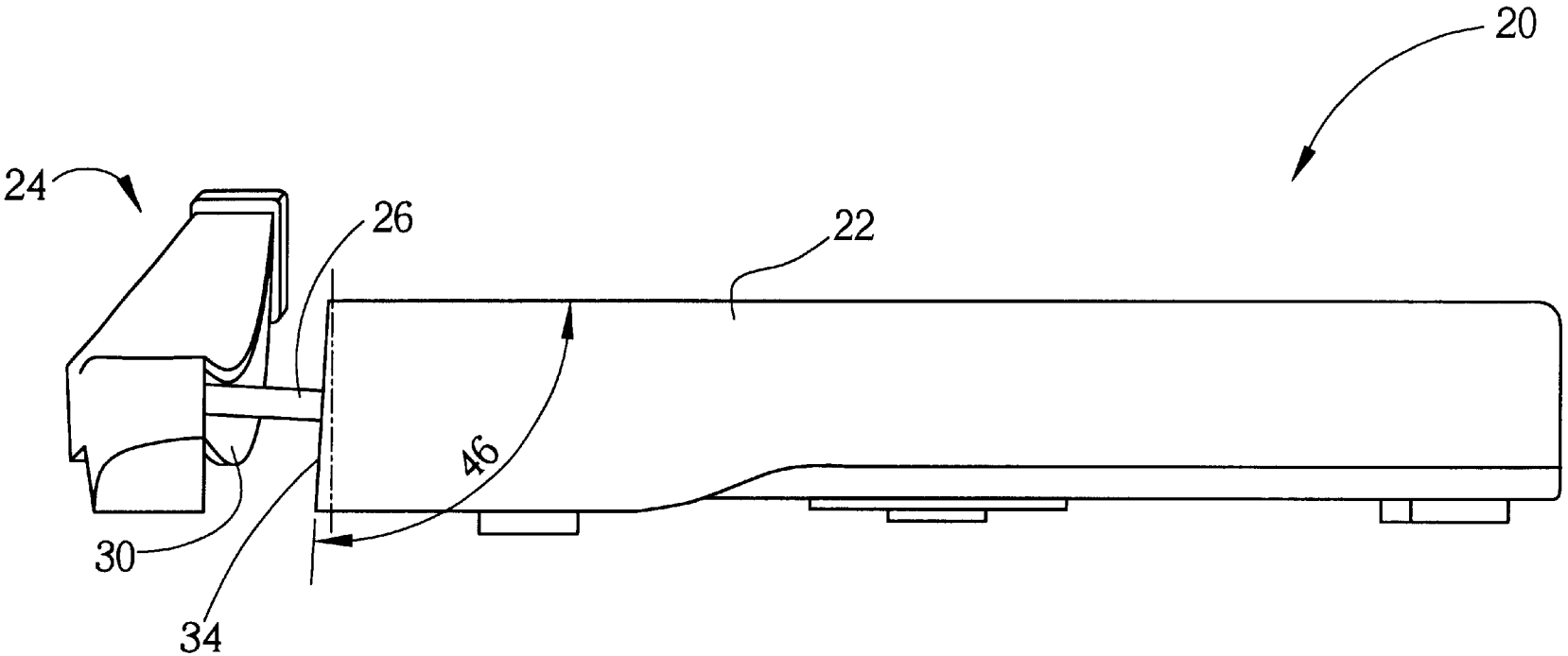
FIG. 4 is a back view of the paper cutter of FIG. 2.

Please refer to FIG. 2 to FIG. 4. FIG. 2 is a schematic diagram of a present invention paper cutter 20, FIG. 3 is a bottom view of the paper cutter 20, and FIG. 4 is a back view of the paper cutter 20. The paper cutter 20 includes a main board 22 for document placement, a cutting member 24, a connecting axle 26 to connect the main board 22 with the cutting member 24, and a torque limiter 38 installed on the engaging side 36 of the main board 22 to limit the height which the cutting member 24 can be lifted.

The main board 22 includes a side blade 32 fixed on the engaging side 36 of the main board 22, a slant surface 34 formed at a front portion of the engaging side 36, and an upper surface 50 for placement of the document. The cutting member 24 includes an edge blade 30 to engage with the side blade 32 of the main board 22 for cutting of the document and a handle 28 to lift the edge blade 30. The side blade 32 includes a flat surface 40 perpendicular to the upper surface 50 of the main board 22. The slant surface 34 extends outwards from a predetermined position 42 of the engaging side 36 to form a first acute angle 44 between 2 to 4 degrees with the flat surface 40 of the side blade 32. The slant surface 34 further extends outwards from its upper edge to form an obtuse angle 46 between 92 to 94 degrees with the upper surface 50 of the main board 22.

Figure 5:
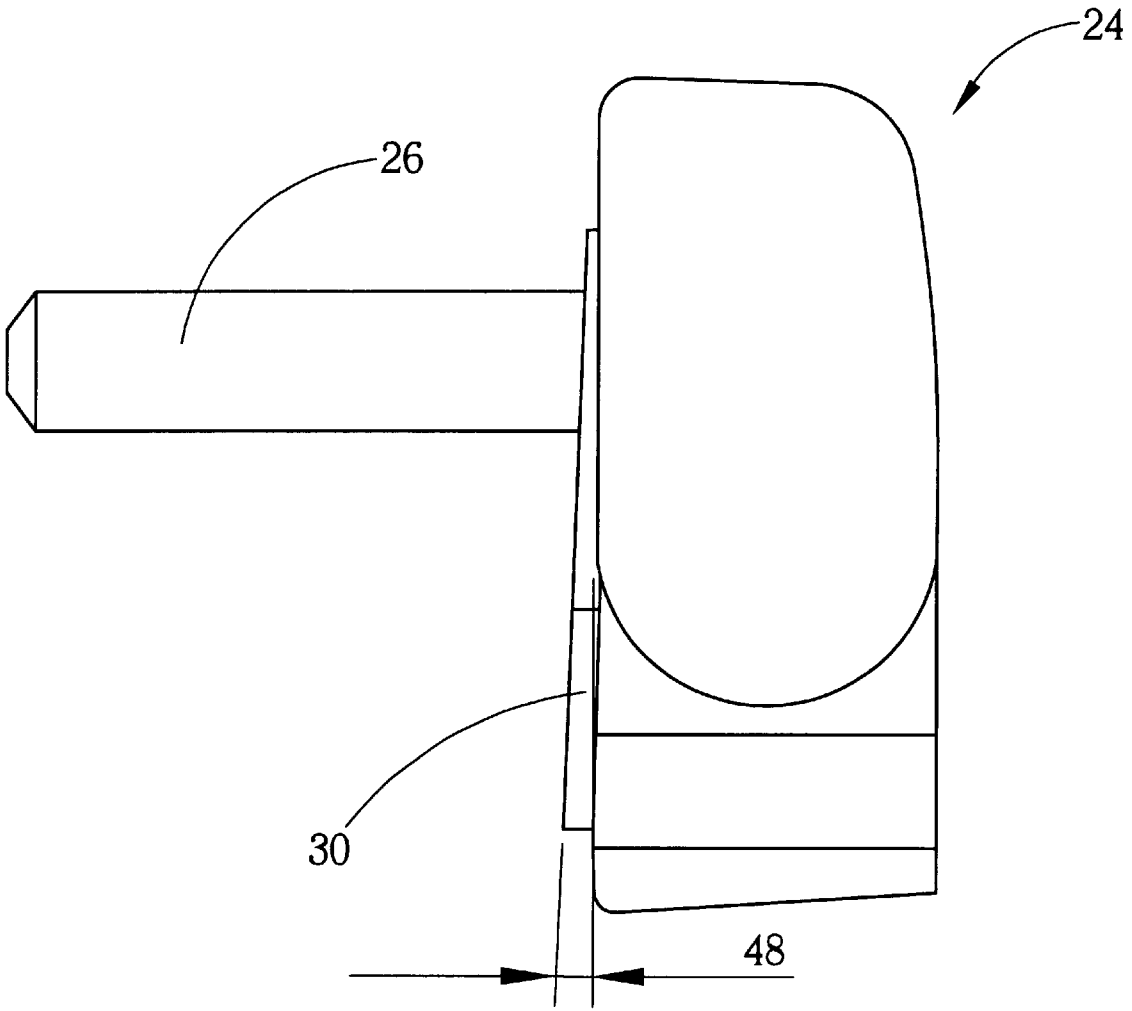
FIG. 5 is a sectional view along line 5—5 of the paper cutter of FIG. 2.

Please refer to FIG. 5. FIG. 5 is a sectional view along line 5—5 of the paper cutter 20 of FIG. 2. The edge blade 30 extends outward from its top side to form a second acute angle 48 between 1.2 to 1.4 degrees with the flat surface 40 of the side blade 32. In the optimal preferred embodiment, the first acute angle 44 is 3 degrees, the second acute angle 48 is 1.3 degrees, and the obtuse angle 46 is 93 degrees. The connecting axle 26 is installed between the slant surface 34 of the main board 22 and the cutting member 24 in a rotatable manner and in perpendicular with the slant surface 44.

As shown in FIG. 3, the predetermined position 42 is approximately located at a front end of the slant surface 44 of the side blade 32. The predetermined position 42 is approximately located at an intersection of a front edge, of the upper surface 50 of the main board 22 and the engaging side 38 of the main board 22. The slant surface 44 of the main board 22 is formed by extending the side blade 32 to the front portion of the engaging side 38 of the main board 22 so that one end of the connecting axle 26 is installed at the front portion of the side blade 32.

In comparison with the prior art paper cutter 10, the paper cutter 20 of the present invention does not require the use of positioning elements to adjust the positions of the cutting member 24 and the main board 22. The formation of the first acute angle 44 and the obtuse angle 46 for the slant surface 34 of the main board 22, and the formation of the second acute angle 48 for the edge blade 30, removes the need of positioning elements for the paper cutter 20. The lack of positioning elements in the paper cutter 20 can therefore decrease the manufacturing time per paper cutter 20 to 2 or 3 minutes as well as prevent misalignments between the cutting member 24 and the main board 22.

Those skilled in the art will readily observe the numerous modifications and alterations of the device may be made while retaining the teachings of the invention. Accordingly, the above disclosure should be construed as limited only by metes and bounds of the appended claims.

What is claimed is:

1. A paper cutter comprising:

a main board for positioning a document, the main board comprising a side blade attached to an engaging side of the main board, and a slant surface formed at a front portion of the engaging side, the side blade having a flat surface perpendicular to an upper surface of the main board, the slant surface extending outwards from a predetermined position of the engaging side to form a first acute angle with the flat surface of the side blade, the slant surface further extending outward with respect to an upper edge of the slant surface to form an obtuse angle with the upper surface of the main board;

a cutting member comprising an edge blade fixed on one side for engaging with the side blade of the main board for cutting the document; and a connecting axle installed between the slant surface of the main board and the cutting member in a rotatable manner, the connecting axle perpendicular to the slant surface.

2. The paper cutter of claim 1 wherein the edge blade extends outward from a top side of the edge blade so as to form a second acute angle with the flat surface of the side blade.

3. The paper cutter of claim 2 wherein the second acute angle is between 1.2 to 1.4 degrees.

4. The paper cutter of claim 1 wherein the first acute angle is between 2 to 4 degrees.

5. The paper cutter of claim 1 wherein the obtuse angle formed between the slant surface and the upper surface of the main board is between 92 to 94 degrees.

6. The paper cutter of claim 1 wherein the cutting member further comprises a handle for lifting the edge blade.

7. The paper cutter of claim 1 further comprising a torque limiter installed on the engaging side of the main board for limiting the height which the cutting member can be lifted.

8. The paper cutter of claim 1 wherein the predetermined position is approximately located at a front end of the flat surface of the side blade.

9. The paper cutter of claim 8 wherein the slant surface of the main board is formed by extending the side blade to the front portion of the engaging side of the main board so that one end of the connecting axle is installed at a front portion of the side blade.

10. The paper cutter of claim 1 wherein the predetermined position is approximately located at an intersection of a front edge of the upper surface of the main board and the engaging side of the main board.

* * * * *